US006953096B2

(12) United States Patent
Gledhill et al.

(10) Patent No.: US 6,953,096 B2
(45) Date of Patent: Oct. 11, 2005

(54) EXPANDABLE BIT WITH SECONDARY RELEASE DEVICE

(75) Inventors: Andrew D. Gledhill, Scotland (GB); Mark S. Fuller, Scotland (GB); Kenneth J. Dalrymple, Perth (AU)

(73) Assignee: Weatherford/Lamb, Inc., Houston, TX (US)

( * ) Notice: Subject to any disclaimer, the term of this patent is extended or adjusted under 35 U.S.C. 154(b) by 94 days.

(21) Appl. No.: 10/335,957

(22) Filed: Dec. 31, 2002

(65) Prior Publication Data

US 2004/0124011 A1 Jul. 1, 2004

(51) Int. Cl.[7] ..... E21B 7/00

(52) U.S. Cl. ..... 175/57; 175/267; 175/271

(58) Field of Search ..... 175/57, 267, 269, 175/271

(56) References Cited

U.S. PATENT DOCUMENTS

| | | | |
|---|---|---|---|
| 1,185,582 | A | 5/1916 | Bignell |
| 1,301,285 | A | 4/1919 | Leonard |
| 1,342,424 | A | 6/1920 | Cotten |
| 1,842,638 | A | 1/1932 | Wigle |
| 1,880,218 | A | 10/1932 | Simmons |
| 1,917,135 | A | 7/1933 | Littell |
| 1,981,525 | A | 11/1934 | Price |
| 2,017,451 | A | 10/1935 | Wickersham |
| 2,049,450 | A | 8/1936 | Johnson |
| 2,060,352 | A | 11/1936 | Stokes |
| 2,214,429 | A | 9/1940 | Miller |
| 2,216,895 | A | 10/1940 | Stokes |
| 2,295,803 | A | 9/1942 | O'Leary |
| 2,324,679 | A | 7/1943 | Cox |
| 2,499,630 | A | 3/1950 | Clark |
| 2,522,444 | A | 9/1950 | Grable |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bieber et al. |
| 2,668,689 | A | 2/1954 | Cormany |
| 2,692,059 | A | 10/1954 | Bolling, Jr. |
| 2,738,011 | A | 3/1956 | Mabry |
| 2,743,087 | A | 4/1956 | Layne et al. |
| 2,743,495 | A | 5/1956 | Eklund |

(Continued)

FOREIGN PATENT DOCUMENTS

| | | |
|---|---|---|
| DE | 3 213 464 | 10/1983 |
| DE | 4 133 802 | 10/1992 |

(Continued)

OTHER PUBLICATIONS

Hahn, et al., "Simultaneous Drill and Case Technology—Case Histories, Status and Options for Further Development, " Society of Petroleum Engineers, IADC/SPE Drilling Conference, New Orlean, LA Feb. 23–25, 2000 pp. 1–9.

(Continued)

*Primary Examiner*—William Neuder
(74) *Attorney, Agent, or Firm*—Moser, Patterson & Sheridan, L.L.P.

(57) ABSTRACT

The present invention generally relates to an apparatus and method of forming a wellbore. In one aspect, an expandable bit for use in a wellbore is provided. The expandable bit includes a body and a blade assembly disposed on the body. The blade assembly is movable between a closed position whereby the expandable bit has a smaller outer diameter and an open position whereby the expandable bit has a larger outer diameter. The expandable bit further includes a release assembly for providing a secondary means to move the blade assembly from the open position to the closed position. In another aspect, a method of forming a wellbore is provided. In yet another aspect, an expandable apparatus for use in forming a wellbore is provided.

24 Claims, 8 Drawing Sheets

U.S. PATENT DOCUMENTS

| | | | | |
|---|---|---|---|---|
| 2,764,329 | A | | 9/1956 | Hampton |
| 2,765,146 | A | | 10/1956 | Williams |
| 2,805,043 | A | | 9/1957 | Williams |
| 3,087,546 | A | | 4/1963 | Wooley |
| 3,102,599 | A | | 9/1963 | Hillburn |
| 3,122,811 | A | | 3/1964 | Gilreath |
| 3,123,160 | A | | 3/1964 | Kammerer |
| 3,159,219 | A | | 12/1964 | Scott |
| 3,169,592 | A | | 2/1965 | Kammerer |
| 3,191,677 | A | | 6/1965 | Kinley |
| 3,191,680 | A | | 6/1965 | Vincent |
| 3,353,599 | A | | 11/1967 | Swift |
| 3,380,528 | A | | 4/1968 | Timmons |
| 3,387,693 | A | | 6/1968 | Hoever |
| 3,392,609 | A | | 7/1968 | Bartos |
| 3,406,769 | A | * | 10/1968 | Kammerer, Jr. ..... 175/269 |
| 3,489,220 | A | | 1/1970 | Kinley |
| 3,518,903 | A | | 7/1970 | Ham et al. |
| 3,550,684 | A | | 12/1970 | Cubberly, Jr. |
| 3,552,508 | A | | 1/1971 | Brown |
| 3,552,509 | A | | 1/1971 | Brown |
| 3,552,510 | A | | 1/1971 | Brown |
| 3,559,739 | A | | 2/1971 | Hutchison |
| 3,570,598 | A | | 3/1971 | Johnson |
| 3,575,245 | A | | 4/1971 | Cordary et al. |
| 3,603,411 | A | | 9/1971 | Link |
| 3,603,412 | A | | 9/1971 | Kammerer, Jr. et al. |
| 3,603,413 | A | | 9/1971 | Grill et al. |
| 3,624,760 | A | | 11/1971 | Bodine |
| 3,656,564 | A | | 4/1972 | Brown |
| 3,669,190 | A | | 6/1972 | Sizer et al. |
| 3,691,624 | A | | 9/1972 | Kinley |
| 3,692,126 | A | | 9/1972 | Rushing et al. |
| 3,700,048 | A | | 10/1972 | Desmoulins |
| 3,729,057 | A | | 4/1973 | Wemer |
| 3,747,675 | A | | 7/1973 | Brown |
| 3,785,193 | A | | 1/1974 | Kinley et al. |
| 3,808,916 | A | | 5/1974 | Porter et al. |
| 3,838,613 | A | | 10/1974 | Wilms |
| 3,840,128 | A | | 10/1974 | Swoboda, Jr. et al. |
| 3,870,114 | A | | 3/1975 | Pulk et al. |
| 3,881,375 | A | | 5/1975 | Kelly |
| 3,885,679 | A | | 5/1975 | Swoboda, Jr. et al. |
| 3,901,331 | A | | 8/1975 | Djurovic |
| 3,934,660 | A | | 1/1976 | Nelson |
| 3,945,444 | A | | 3/1976 | Knudson |
| 3,964,556 | A | | 6/1976 | Gearhart et al. |
| 3,980,143 | A | | 9/1976 | Swartz et al. |
| 4,049,066 | A | | 9/1977 | Richey |
| 4,054,426 | A | | 10/1977 | White |
| 4,064,939 | A | | 12/1977 | Marquis |
| 4,077,525 | A | | 3/1978 | Callegari et al. |
| 4,082,144 | A | | 4/1978 | Marquis |
| 4,083,405 | A | | 4/1978 | Shirley |
| 4,085,808 | A | | 4/1978 | Kling |
| 4,100,968 | A | | 7/1978 | Delano |
| 4,100,981 | A | | 7/1978 | Chaffin |
| 4,133,396 | A | | 1/1979 | Tschirky |
| 4,142,739 | A | | 3/1979 | Billingsley |
| 4,173,457 | A | | 11/1979 | Smith |
| 4,175,619 | A | | 11/1979 | Davis |
| 4,186,628 | A | | 2/1980 | Bonnice |
| 4,189,185 | A | | 2/1980 | Kammerer, Jr. et al. |
| 4,221,269 | A | | 9/1980 | Hudson |
| 4,257,442 | A | | 3/1981 | Claycomb |
| 4,262,693 | A | | 4/1981 | Giebeler |
| 4,274,777 | A | | 6/1981 | Scaggs |
| 4,274,778 | A | | 6/1981 | Putnam et al. |
| 4,281,722 | A | | 8/1981 | Tucker et al. |
| 4,282,941 | A | * | 8/1981 | Perkin ..... 175/267 |
| 4,287,949 | A | | 9/1981 | Lindsey, Jr. |
| 4,315,553 | A | | 2/1982 | Stallings |
| 4,320,915 | A | | 3/1982 | Abbott et al. |
| 4,336,415 | A | | 6/1982 | Walling |
| 4,384,627 | A | | 5/1983 | Ramirez-Jauregui |
| 4,396,076 | A | | 8/1983 | Inoue |
| 4,396,077 | A | | 8/1983 | Radtke |
| 4,408,669 | A | | 10/1983 | Wiredal |
| 4,413,682 | A | | 11/1983 | Callihan et al. |
| 4,440,220 | A | | 4/1984 | McArthur |
| 4,446,745 | A | | 5/1984 | Stone et al. |
| 4,460,053 | A | | 7/1984 | Jurgens et al. |
| 4,463,814 | A | | 8/1984 | Horstmeyer et al. |
| 4,466,498 | A | | 8/1984 | Bardwell |
| 4,470,470 | A | | 9/1984 | Takano |
| 4,472,002 | A | | 9/1984 | Beney et al. |
| 4,474,243 | A | | 10/1984 | Gaines |
| 4,483,399 | A | | 11/1984 | Colgate |
| 4,489,793 | A | | 12/1984 | Boren |
| 4,515,045 | A | | 5/1985 | Gnatchenko et al. |
| 4,544,041 | A | | 10/1985 | Rinaldi |
| 4,545,443 | A | | 10/1985 | Wiredal |
| 4,565,252 | A | * | 1/1986 | Campbell et al. ..... 175/269 |
| 4,580,631 | A | | 4/1986 | Baugh |
| 4,583,603 | A | | 4/1986 | Dorleans et al. |
| 4,589,495 | A | | 5/1986 | Langer et al. |
| 4,595,058 | A | | 6/1986 | Nations |
| 4,604,724 | A | | 8/1986 | Shaginian et al. |
| 4,604,818 | A | | 8/1986 | Inoue |
| 4,605,077 | A | | 8/1986 | Boyadjieff |
| 4,620,600 | A | | 11/1986 | Persson |
| 4,630,691 | A | | 12/1986 | Hooper |
| 4,651,837 | A | | 3/1987 | Mayfield |
| 4,652,195 | A | | 3/1987 | McArthur |
| 4,655,286 | A | | 4/1987 | Wood |
| 4,660,657 | A | * | 4/1987 | Furse et al. ..... 175/269 |
| 4,671,358 | A | | 6/1987 | Lindsey, Jr. et al. |
| 4,681,158 | A | | 7/1987 | Pennison |
| 4,686,873 | A | | 8/1987 | Lang et al. |
| 4,699,224 | A | | 10/1987 | Burton |
| 4,725,179 | A | | 2/1988 | Woolslayer et al. |
| 4,735,270 | A | | 4/1988 | Fenyvesi |
| 4,760,882 | A | | 8/1988 | Novak |
| 4,762,187 | A | | 8/1988 | Haney |
| 4,765,416 | A | | 8/1988 | Bjerking et al. |
| 4,813,495 | A | | 3/1989 | Leach |
| 4,825,947 | A | | 5/1989 | Mikolajczyk |
| 4,832,552 | A | | 5/1989 | Skelly |
| 4,836,299 | A | | 6/1989 | Bodine |
| 4,842,081 | A | | 6/1989 | Parant |
| 4,843,945 | A | | 7/1989 | Dinsdale |
| 4,848,469 | A | | 7/1989 | Baugh et al. |
| 4,854,386 | A | | 8/1989 | Baker et al. |
| 4,880,058 | A | | 11/1989 | Lindsey et al. |
| 4,904,119 | A | | 2/1990 | Legendre et al. |
| 4,921,386 | A | | 5/1990 | McArthur |
| 4,960,173 | A | | 10/1990 | Cognevich et al. |
| 4,962,822 | A | | 10/1990 | Pascale |
| 4,997,042 | A | | 3/1991 | Jordan et al. |
| 5,022,472 | A | | 6/1991 | Bailey et al. |
| 5,027,914 | A | | 7/1991 | Wilson |
| 5,049,020 | A | | 9/1991 | McArthur |
| 5,052,483 | A | | 10/1991 | Hudson |
| 5,060,542 | A | | 10/1991 | Hauk |
| 5,060,737 | A | | 10/1991 | Mohn |
| 5,074,366 | A | | 12/1991 | Karlsson et al. |
| 5,082,069 | A | | 1/1992 | Seiler et al. |
| 5,096,465 | A | | 3/1992 | Chen et al. |
| 5,109,924 | A | | 5/1992 | Jurgens et al. |
| 5,111,893 | A | | 5/1992 | Kvello-Aune |
| 5,148,875 | A | | 9/1992 | Karlsson et al. |

5,160,925 A 11/1992 Dailey et al.
5,168,942 A 12/1992 Wydrinski
5,172,765 A 12/1992 Sas-Jaworsky
5,181,571 A 1/1993 Mueller
5,186,265 A 2/1993 Henson et al.
5,191,939 A 3/1993 Stokley
5,197,553 A 3/1993 Leturno
5,234,052 A 8/1993 Coone et al.
5,255,741 A 10/1993 Alexander
5,255,751 A 10/1993 Stogner
5,271,472 A 12/1993 Leturno
5,282,653 A 2/1994 LaFleur et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,318,122 A 6/1994 Murray et al.
5,320,178 A 6/1994 Cornette
5,322,127 A 6/1994 McNair et al.
5,323,858 A 6/1994 Jones et al.
5,332,048 A 7/1994 Underwood et al.
5,343,950 A 9/1994 Hale et al.
5,343,951 A 9/1994 Cowan et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,402,856 A 4/1995 Warren et al.
5,435,400 A 7/1995 Smith
5,452,923 A 9/1995 Smith
5,458,209 A 10/1995 Hayes et al.
5,472,057 A 12/1995 Winfree
5,477,925 A 12/1995 Trahan et al.
5,497,840 A 3/1996 Hudson
5,520,255 A 5/1996 Barr et al.
5,526,880 A 6/1996 Jordan, Jr. et al.
5,535,824 A 7/1996 Hudson
5,535,838 A 7/1996 Keshavan et al.
5,546,317 A 8/1996 Andrieu
5,547,029 A 8/1996 Rubbo et al.
5,551,521 A 9/1996 Vail, III
5,553,679 A 9/1996 Thorp
5,560,437 A 10/1996 Dickel et al.
5,560,440 A 10/1996 Tibbitts
5,575,344 A 11/1996 Wireman
5,582,259 A 12/1996 Barr
5,584,343 A 12/1996 Coone
5,613,567 A 3/1997 Hudson
5,615,747 A 4/1997 Vail, III
5,651,420 A 7/1997 Tibbitts et al.
5,661,888 A 9/1997 Hanslik
5,662,170 A 9/1997 Donovan et al.
5,662,182 A 9/1997 McLeod et al.
5,667,023 A 9/1997 Harrell et al.
5,667,026 A 9/1997 Lorenz et al.
5,706,905 A 1/1998 Barr
5,711,382 A 1/1998 Hansen et al.
5,717,334 A 2/1998 Vail, III et al.
5,720,356 A 2/1998 Gardes
5,732,776 A 3/1998 Tubel et al.
5,735,348 A 4/1998 Hawkins, III
5,743,344 A 4/1998 McLeod et al.
5,746,276 A 5/1998 Stuart
5,785,132 A 7/1998 Richardson et al.
5,785,134 A 7/1998 McLeod et al.
5,787,978 A 8/1998 Carter et al.
5,803,666 A 9/1998 Keller
5,826,651 A 10/1998 Lee et al.
5,828,003 A 10/1998 Thomeer et al.
5,829,520 A 11/1998 Johnson
5,833,002 A 11/1998 Holcombe
5,836,409 A 11/1998 Vail, III
5,839,330 A 11/1998 Stokka
5,839,519 A 11/1998 Spedale, Jr.
5,842,530 A 12/1998 Smith et al.
5,845,722 A 12/1998 Makohl et al.
5,860,474 A 1/1999 Stoltz et al.
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,908,049 A 6/1999 Williams et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,957,225 A 9/1999 Sinor
5,971,079 A 10/1999 Mullins
6,000,472 A 12/1999 Albright et al.
6,024,169 A 2/2000 Haugen
6,026,911 A 2/2000 Angle et al.
6,035,953 A 3/2000 Rear
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,671 A 6/2000 Cumming et al.
6,098,717 A 8/2000 Bailey et al.
6,119,772 A 9/2000 Pruet
6,135,208 A 10/2000 Gano et al.
6,155,360 A 12/2000 McLeod
6,158,531 A 12/2000 Vail, III
6,170,573 B1 1/2001 Brunet et al.
6,172,010 B1 1/2001 Argillier et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,206,112 B1 3/2001 Dickinson, III et al.
6,216,533 B1 4/2001 Woloson et al.
6,220,117 B1 4/2001 Butcher
6,234,257 B1 5/2001 Ciglenec et al.
6,263,987 B1 7/2001 Vail, III
6,296,066 B1 10/2001 Terry et al.
6,305,469 B1 10/2001 Coenen et al.
6,311,792 B1 11/2001 Scott et al.
6,315,051 B1 11/2001 Ayling
6,325,148 B1 12/2001 Trahan et al.
6,343,649 B1 2/2002 Beck et al.
6,357,485 B2 3/2002 Quigley et al.
6,359,569 B2 3/2002 Beck et al.
6,371,203 B2 4/2002 Frank et al.
6,374,924 B1 4/2002 Hanton et al.
6,378,627 B1 4/2002 Tubel et al.
6,378,630 B1 4/2002 Ritorto et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.

| | | | | |
|---|---|---|---|---|
| 6,419,033 | B1 | 7/2002 | Hahn et al. | |
| 6,427,776 | B1 | 8/2002 | Hoffman et al. | |
| 6,443,241 | B1 | 9/2002 | Juhasz et al. | |
| 6,443,247 | B1 | 9/2002 | Wardley | |
| 6,457,532 | B1 | 10/2002 | Simpson | |
| 6,464,004 | B1 | 10/2002 | Crawford et al. | |
| 6,484,818 | B2 | 11/2002 | Alft et al. | |
| 6,497,280 | B2 | 12/2002 | Beck et al. | |
| 6,527,047 | B1 | 3/2003 | Pietras | |
| 6,527,064 | B1 | 3/2003 | Hallundbaek | |
| 6,536,520 | B1 | 3/2003 | Snider et al. | |
| 6,536,993 | B2 | 3/2003 | Strong et al. | |
| 6,538,576 | B1 | 3/2003 | Schultz et al. | |
| 6,543,552 | B1 | 4/2003 | Metcalfe et al. | |
| 6,547,017 | B1 | 4/2003 | Vail, III | |
| 6,554,064 | B1 | 4/2003 | Restarick et al. | |
| 6,591,471 | B1 | 7/2003 | Hollingsworth et al. | |
| 6,634,430 | B2 | 10/2003 | Dawson et al. | |
| 6,668,937 | B1 | 12/2003 | Murray | |
| 6,702,040 | B1 | 3/2004 | Sensenig | |
| 6,742,606 | B2 | 6/2004 | Metcalfe et al. | |
| 2001/0000101 | A1 | 4/2001 | Lovato et al. | |
| 2001/0002626 | A1 | 6/2001 | Frank et al. | |
| 2001/0013412 | A1 | 8/2001 | Tubel | |
| 2001/0040054 | A1 | 11/2001 | Haugen et al. | |
| 2001/0042625 | A1 | 11/2001 | Appleton | |
| 2001/0047883 | A1 | 12/2001 | Hanton et al. | |
| 2002/0040787 | A1 | 4/2002 | Cook et al. | |
| 2002/0066556 | A1 | 6/2002 | Goode et al. | |
| 2002/0074127 | A1 | 6/2002 | Birckhead et al. | |
| 2002/0074132 | A1 | 6/2002 | Juhasz et al. | |
| 2002/0079102 | A1 | 6/2002 | Dewey et al. | |
| 2002/0134555 | A1 | 9/2002 | Allen et al. | |
| 2002/0157829 | A1 | 10/2002 | Davis et al. | |
| 2002/0162690 | A1 | 11/2002 | Hanton et al. | |
| 2002/0189806 | A1 | 12/2002 | Davidson et al. | |
| 2002/0189863 | A1 | 12/2002 | Wardley | |
| 2003/0034177 | A1 | 2/2003 | Chitwood et al. | |
| 2003/0056991 | A1 | 3/2003 | Hahn et al. | |
| 2003/0070841 | A1 | 4/2003 | Merecka et al. | |
| 2003/0079913 | A1 * | 5/2003 | Eppink et al. | 175/61 |
| 2003/0111267 | A1 | 6/2003 | Pia | |
| 2003/0141111 | A1 | 7/2003 | Pia | |
| 2003/0146023 | A1 | 8/2003 | Pia | |
| 2003/0183424 | A1 * | 10/2003 | Tulloch | 175/263 |
| 2003/0217865 | A1 | 11/2003 | Simpson et al. | |
| 2003/0221519 | A1 | 12/2003 | Haugen et al. | |
| 2004/0003490 | A1 | 1/2004 | Shahin et al. | |
| 2004/0003944 | A1 | 1/2004 | Vincent et al. | |
| 2004/0011534 | A1 | 1/2004 | Simonds et al. | |
| 2004/0069501 | A1 | 4/2004 | Haugen et al. | |
| 2004/0112603 | A1 | 6/2004 | Galloway et al. | |
| 2004/0118614 | A1 | 6/2004 | Galloway et al. | |
| 2004/0124010 | A1 | 7/2004 | Galloway et al. | |
| 2004/0124011 | A1 | 7/2004 | Gledhill et al. | |

FOREIGN PATENT DOCUMENTS

| | | | |
|---|---|---|---|
| EP | 0 235 105 | 9/1987 | |
| EP | 0 265 344 | 4/1988 | |
| EP | 0 462 618 | 12/1991 | |
| EP | 0 554 568 | 8/1993 | |
| EP | 0 571 045 | 8/1998 | E21B/7/06 |
| EP | 0 961 007 | 12/1999 | |
| EP | 1 006 260 | 6/2000 | |
| EP | 1 050 661 | 11/2000 | E21B/7/18 |
| FR | 2053088 | 7/1970 | |
| GB | 540 027 | 10/1941 | |
| GB | 7 928 86 | 4/1958 | |
| GB | 8 388 33 | 6/1960 | |
| GB | 9 977 21 | 7/1965 | |
| GB | 1 277 461 | 6/1972 | |
| GB | 1 448 304 | 9/1976 | |
| GB | 1 469 661 | 4/1977 | |
| GB | 1 582 392 | 1/1981 | |
| GB | 2 053 088 | 2/1981 | |
| GB | 2 201 912 | 9/1988 | |
| GB | 2 216 926 | 10/1989 | |
| GB | 2 294 715 | 8/1996 | |
| GB | 2 313 860 | 2/1997 | |
| GB | 2 320 270 | 6/1998 | |
| GB | 2 333 542 | 7/1999 | |
| GB | 2 335 217 | 9/1999 | |
| GB | 2 348 223 | 9/2000 | |
| GB | 2 357 101 | 6/2001 | E21B/7/06 |
| GB | 2 352 747 | 7/2001 | |
| GB | 2 365 463 | 2/2002 | |
| GB | 2 382 361 | 5/2003 | |
| SU | 112631 | 1/1956 | |
| SU | 659260 | 4/1967 | |
| SU | 247162 | 5/1967 | |
| SU | 395557 | 12/1971 | |
| SU | 415346 | 3/1972 | |
| SU | 481689 | 6/1972 | |
| SU | 461218 | 4/1973 | |
| SU | 501139 | 12/1973 | |
| SU | 585266 | 7/1974 | |
| SU | 583278 | 8/1974 | |
| SU | 601390 | 1/1976 | |
| SU | 581238 | 2/1976 | |
| SU | 655843 | 3/1977 | |
| SU | 781312 | 3/1978 | |
| SU | 899820 | 6/1979 | |
| SU | 955765 | 2/1981 | |
| SU | 1304470 | 8/1984 | |
| SU | 1618870 | 1/1991 | E21B/33/14 |
| SU | 1808972 | 5/1991 | |
| WO | WO 90/06418 | 6/1990 | |
| WO | WO 91/16520 | 10/1991 | |
| WO | WO 92/01139 | 1/1992 | |
| WO | WO 92/18743 | 10/1992 | |
| WO | WO 92/20899 | 11/1992 | |
| WO | WO 93/24728 | 12/1993 | |
| WO | WO 95/10686 | 4/1995 | |
| WO | WO 96/28635 | 9/1996 | |
| WO | WO 97/08418 | 3/1997 | E21B/4/18 |
| WO | WO 98/09053 | 3/1998 | |
| WO | WO 98/55730 | 12/1998 | E21B/23/00 |
| WO | WO 99/11902 | 3/1999 | |
| WO | WO 99/23354 | 5/1999 | |
| WO | WO 99/37881 | 7/1999 | |
| WO | WO 99/50528 | 10/1999 | |
| WO | WO 99/64713 | 12/1999 | |
| WO | WO 00/05483 | 2/2000 | E21B/19/16 |
| WO | WO 00/08293 | 2/2000 | |
| WO | WO 00/11309 | 3/2000 | E21B/19/16 |
| WO | WO 00/11310 | 3/2000 | E21B/19/16 |
| WO | WO 00/11311 | 3/2000 | E21B/19/16 |
| WO | WO 00/28188 | 5/2000 | E21B/7/06 |
| WO | WO 00/37766 | 6/2000 | |
| WO | WO 00/37771 | 6/2000 | E21B/43/10 |
| WO | WO 00/50730 | 8/2000 | E21B/10/66 |
| WO | WO 01/12946 | 2/2001 | E21B/19/00 |
| WO | WO 01/46550 | 6/2001 | E21B/7/20 |
| WO | WO 01/79650 | 10/2001 | E21B/10/60 |
| WO | WO 01/81708 | 11/2001 | E21B/10/32 |
| WO | WO 01/81708 A1 * | 11/2001 | E21B/10/32 |
| WO | WO 01/83932 | 11/2001 | |
| WO | WO 01/94738 | 12/2001 | E21B/7/20 |
| WO | WO 01/94739 | 12/2001 | E21B/7/20 |
| WO | WO 02/086287 | 10/2002 | E21B/47/01 |

OTHER PUBLICATIONS

M.B. Stone and J. Smith, "Expandable Tubulars and Casing Drilling are Options" Drilling Contractor, Jan./Feb. 2002, pp. 52.
M. Gelfgat, "Retractable Bits Development and Application" Transactions of the ASME, vol. 120, Jun. (1998), pp. 124–130.
"First Success with Casing–Drilling" Word Oil, Feb. (1999), pp. 25.
Dean E. Gaddy, Editor, "Russia Shares Technical Know–How with U.S." Oil & Gas Journal, Mar. (1999), pp. 51–52 and 54–56.
U.S. Appl. No. 10/794,800, filed Mar. 5, 2004 (WEAT/0360).
U.S. Appl. No. 10/832,804, filed Apr. 27, 2004 (WEAT/0383.P1).
U.S. Appl. No. 10/795,214, filed Mar. 5, 2004 (WEAT/0373).
U.S. Appl. No. 10/794,795, filed Mar. 5, 2004 (WEAT/0357).
U.S. Appl. No. 10/775,048, filed Feb. 9, 2004 (WEAT/0359).
U.S. Appl. No. 10/772,217, filed Feb. 2, 2004 (WEAT/0344).
U.S. Appl. No. 10/788,976, filed Feb. 27, 2004 (WEAT/0372).
U.S. Appl. No. 10/794,797, filed Mar. 5, 2004 (WEAT/0371).
U.S. Appl. No. 10/767,322, filed Jan. 29, 2004 (WEAT/0343).
U.S. Appl. No. 10/795,129, filed Mar. 5, 2004 (WEAT/0366).
U.S. Appl. No. 10/794,790, filed Mar. 5, 2004 (WEAT/0329).
U.S. Appl. No. 10/162,302, filed Jun. 4, 2004 (WEAT/0410).
Rotary Steerable Technology—Technology Gains Momentum, Oil & Gas Journal, Dec. 28, 1998.
Directional Drilling, M. Mims, World Oil, May 1999, pp. 40–43.
Multilateral Classification System w/Example Applications, Alan MacKenzie & Cliff Hogg, World Oil, Jan. 1999, pp. 55–61.
U.S. Appl. No. 10/618,093.
U.S. Appl. No. 10/189,570.
Tarr, et al., "Casing–while–Drilling: The Next Step Change In Well Construction," World Oil, Oct. 1999, pp. 34–40.
De Leon Mojarro, "Breaking A Paradigm: Drilling With Tubing Gas Wells," SPE Paper 40051, SPE Annual Technical Conference And Exhibition, Mar. 3–5, 1998, pp. 465–472.
De Leon Mojarro, "Drilling/Completing With Tubing Cuts Well Costs By 30%," World Oil, Jul. 1998, pp. 145–150.
Littleton, "Refined Slimhole Drilling Technology Renews Operator Interest," Petroleum Engineer International, Jun. 1992, pp. 19–26.
Anon, "Slim Holes Fat Savings," Journal of Petroleum Technology, Sep. 1992, pp. 816–819.
Anon, "Slim Holes, Slimmmer Prospect," Journal of Petroleum Technology, Nov. 1995, pp. 949–952.
Vogt, et al., "Drilling Liner Technology For Depleted Reservoir," SPE Paper 36827, SPE Annual Technical Conference And Exhibition, Oct. 22–24, pp. 127–132.
Mojarro, et al., "Drilling/Completing With Tubing Cuts Well Costs By 30%," World Oil, Jul. 1998, pp. 145–150.
Sinor, et al., Rotary Liner Drilling For Depleted Reservoirs, IADC/SPE Paper 39399, IADC/SPE Drilling Conference, Mar. 3–6, 1998, pp 1–13.
Editor, "Innovation Starts At The Top At Tesco," The American Oil & Gas Reporter, Apr., 1998, p. 65.
Tessari, et al., "Casing Drilling—A Revolutionary Approach To Reducing Well Costs," SPE/IADC Paper 52789, SPE/IADC Drilling Conference, Mar. 9–11, 1999, pp. 221–225.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99–120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99–121, CADE/CAODC Spring Drilling Conference, Apr. 7 & 8, 1999, pp. 1–12.
Tessari, et al., "Focus: Drilling With Casing Promises Major Benefits," Oil & Gas Journal, May 17, 1999, pp. 58–62.
Laurerit, et al., "Hydraulic Rig Supports Casing Drilling, " World Oil, Sep. 1999, pp. 61–68.
Perdue, et al., "Casing Technology Improves," Hart's E & P, Nov. 1999, pp. 125–136.
Warren, et al., "Casing Drilling Application Design Considerations," IADC/SPE Paper 59179, IADC/SPE Drilling Conference, Feb. 23–25, 2000 pp 1–11.
Warren, et al., "Drilling Technology: Part I—Casing Drilling With Directional Steering In The U.S. Gulf Of Mexico," Offshore, Jan. 2001, pp 50–52.
Warren, et al., "Drilling Technology: Part II—Casing Drilling With Directional Steering In The Gulf Of Mexico," Offshore, Feb. 2001, pp. 40–42.
Shephard, et al., "Casing Drilling: An Emerging Technology," IADC/SPE Paper 67731, SPE/IADC Drilling Conference, Feb. 27–Mar. 1, 2001, pp. 1–13.
Editor, "Tesco Finishes Field Trial Program," Drilling Contractor, Mar./Apr. 2001, p. 53.
Warren, et al., "Casing Drilling Technology Moves To More Challenging Application," AADE Paper O1–NC–HO–32, AADE National Drilling Conference, Mar. 27–29, 2001, pp. 1–10.
Shephard, et al., "Casing Drilling: An Emerging Technology," SPE Drilling & Completion, Mar. 2002, pp. 4–14.
Shephard, et al., "Casing Drilling Successfully Applied in Southern Wyoming," World Oil, Jun. 2002, pp. 33–41.
Forest, et al., "Subsea Equipment For Deep Water Drilling Using Dual Gradient Mud System," SPE/IADC Drilling Conference, Amsterdam, The Netherlands, Feb. 27, 2001–Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3–6, 1999, pp. 1–16.
Coronado, et al., "Development Of A One–Trip ECP Cement Inflation And Stage Cementing System For Open Hole Completions," IADC/SPE Paper 39345, IADC/SPE Drilling Conference, Mar. 3–6, 1998, pp. 473–481.

Coronado, et al., "A One–Trip External–Casing–Packer Cement–Inflation And Stage–Cementing System," Journal Of Petroleum Technology, Aug. 1998, pp. 76–77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9–11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5–6, 2000, pp 1–9.
Cales, et al., Subsidence Remediation—Extending Well Life Through The Use Of Solid Expandable Casing Systems, AADE Paper 01–NC–HO–24, American Association Of Drilling Engineers, Mar. 2001 Conference, pp. 1–16.
Coats, et al., "The Hybrid Drilling Unite: An Overview Of an Integrated Composite Coiled Tubing And Hydaulic Workover Drilling System," SPE Paper 74349, SPE International Petroleum Conference And Exhibition, Feb. 10–12, 2002, pp. 1–7.
Sander, et al., "Project Management And Technology Provide Enhanced Performance For Shallow Horizontal Wells," IADC/SPE Paper 74466, IADC/SPE Drilling Conference, Feb. 26–28, 2002, pp. 1–9.
Coats, et al., "The Hybrid Drilling System: Incorporating Composite Coiled Tubing And Hydraulic Workover Technologies Into One Integrated Drilling System, " IADC/SPE Paper 74538, IADC/SPE Drilling Conference, Feb. 26–28, 2002, pp 1–7.
Galloway, "Rotary Drilling With Casing—A Field Proven Method Of Reducing Wellbore Construction Cost," Paper WOCD–0306092, World Oil Casing Drilling Technical Conference, Mar. 6–7, 2003, pp. 1–7.
Fontenot, et al., "New Rig Design Enhances Casing Drilling Operations In Lobo Trend," paper WOCD–0306–04, World Oil Casing Drilling Technical Conference, Mar. 6–7, 2003, pp. 1–13.
McKay, et al., "New Developments In The Technology Of Drilling With Casing: Ultilizing A Displaceable DrillShoe Tool," Paper WOCD–0306–05, World Oil Casing Drilling Technical Conference, Mar. 6–7, 2003, pp. 1–11.
Sutriono—Santos, et al., "Drilling With Casing Advances To Floating Drilling Unit With Surface BOP Employed," Paper WOCD–0307–01, World Oil Casing Drilling Technical Conference, Mar. 6–7, 2003, pp. 1–7.
Vincent, et al., "Liner And Casing Drilling—Case Histories And Technology," Paper WOCD–0307–02, World Oil Casing Drilling Technical Conference, Mar. 6–7, 2003, pp. 1–20.
Maute, "Electrical Logging: State–of–the Art," The Log Analyst, May–Jun. 1992, pp. 206–227.
Tessari, et al., "Retrievable Tools Provide Flexibility for Casing Drilling," Paper No. WOCD–0306–01, World Oil Casing Drilling Technical Conference, 2003, pp. 1–11.
Evans, et al., "Development And Testing Of An Economical Casing Connection For Use In Drilling Operations," paper WOCD–0306–03, World Oil Casing Drilling Technical Conference, Mar. 6–7, 2003, pp. 1–10.
U.K. Search Report, Application No. GB 0329896.5, dated Mar. 10, 2004.

* cited by examiner

EXPANDABLE BIT WITH SECONDARY RELEASE DEVICE

BACKGROUND OF THE INVENTION

1. Field of the Invention

The present invention generally relates to wellbore construction. More particularly, the invention relates to an apparatus and method for deactivating a downhole tool. More particularly still, the invention relates to an expandable bit with a secondary release device.

2. Description of the Related Art

In the drilling of oil and gas wells, a wellbore is formed using a drill bit that is urged downwardly at a lower end of a drill string. The drill bit generally includes a body portion for securing the drill bit to the drill string and a crown portion to form the wellbore. After drilling a predetermined depth, the drill string and the drill bit are removed, and the wellbore is lined with a string of steel pipe called casing. The casing typically includes a smaller outside diameter than the drill bit that formed the wellbore. The casing provides support to the wellbore and facilitates the isolation of certain areas of the wellbore adjacent hydrocarbon bearing formations. The casing typically extends down the wellbore from the surface of the well to a designated depth. An annular area is thus defined between the outside of the casing and the earth formation. This annular area is filled with cement to permanently set the casing in the wellbore and to facilitate the isolation of production zones and fluids at different depths within the wellbore.

In a conventional completion operation, it is common to employ more than one string of casing in a wellbore. In this respect, the well is drilled to a second designated depth of a smaller diameter, and a second string of casing, or liner, is run into the drilled out portion of the wellbore. The second string is set at a depth such that the upper portion of the second string of casing overlaps the lower portion of the first string of casing and then cemented in place. This process is typically repeated with additional casing strings until the well has been drilled to a total depth. As more casing strings are set in the wellbore, the casing strings become progressively smaller in diameter in order to fit within the previous casing string. In the conventional completion operation, the drill bits must be progressively smaller as the diameter of each casing string decreases in order to fit within the previous casing string.

From time to time, for a variety of reasons it is necessary to form a portion of a wellbore that is at least as large as the section of the cased wellbore thereabove. For example, a monobore well consist of a sequence of expandable liners that are run through the existing casing, then expanded to achieve the same post-expansion through-bore. In forming the monobore well, the portion of the wellbore below the cased portion must be at least as large as the section of the cased wellbore thereabove.

There are a variety of different methods of forming an enlarged wellbore. One such method is by positioning a conventional under-reamer behind the drill bit to cut the enlarged wellbore. In this drilling configuration, the drill bit acts as a pilot bit to cut the inner cross-sectional area while the under-reamer enlarges the cross-sectional area. Generally, the conventional under-reamer includes a number of expandable arms that move between a closed position and an open position. The ability of the conventional under-reamer to open and close the arms allows the under-reamer in the closed position and the pilot bit to travel though a smaller diameter casing. After passing through the casing the underreamer may be opened to form an enlarged diameter bore below the casing shoe resulting in a wellbore equal to or larger than the original drilled hole. Thereafter, the enlarged wellbore may be lined with expandable liners. This procedure of forming the enlarged borehole, although effective may be time consuming and expensive.

In recent years bi-center bits have been developed as an alternative to the conventional under-reamer. Generally, the bi-center bit includes offset cutting members mounted at irregular intervals around the crown of the bit. As the bi-center bit is rotated, the offset cutting members rotate to form an enlarged wellbore. Although, this method of forming an enlarged wellbore is becoming more common the bi-center bits are unstable due to their irregular structure and tend to be more difficult to control for directional purposes than ordinary drill bits. Additionally, the bi-center bits may not drill the expected swept diameter of the offset pads which ream the pilot hole created by the crown.

More recently, an expandable bit has been used to form an enlarged portion of the wellbore. The expandable bit was introduced to over come the deficiencies in the conventional under-reamer and the bi-center bit. An example of an expandable bit is disclosed in International Publication Number WO 01/81708 A1, which is incorporated herein in its entirety. Similar to the conventional under-reamer, the expandable bit includes a set of blades that move between an open position and a closed position. Generally, hydraulic fluid flows through the center of the expandable bit controls the movement of the blades between the open and the closed position. A more detailed discussion of the expandable bit will be described in subsequent paragraphs.

Even though the expandable bit overcomes many of the deficiencies in the conventional under-reamer and the bi-center bit, a problem still exists with the use of the expandable bit to form an enlarged wellbore. The problem includes the possibility that the expandable bit will become stuck in the open position due to some unforeseen event, like a failure in the hydraulic fluid flow or debris that causes the blades to become jammed. For example, the hydraulic fluid used to operate the tool may contain debris or other small particles intermixed with the fluid portion. As the hydraulic fluid flows through the expandable bit, the debris builds inside the tool and eventually may affect the closing of the expandable bit.

The problem results in the expandable bit being stuck downhole because the expandable bit cannot travel through the casing in the open position. When this problem occurs, an operator has several options, however, each option has significant drawbacks. One option is to remove the cemented casing string to access the stuck expandable bit. This option is very time consuming and costly. Another option is to cut the drill string and leave the stuck expandable bit downhole. Thereafter, the operator may drill around the stuck expandable bit or "side track" the well. Although this option is less destructive than the previous option, drilling around an obstruction requires special downhole tools that may not be available at the wellsite. Another option is to mill through the stuck expandable bit. This option is problematic because the expandable bit is constructed from hardened material, resulting in a difficult milling operation that requires replacing the mill tool multiple times.

In view of the deficiency of the expandable drill bit, a need therefore exists for an expandable bit with a release device to shift the blades from the open position to the closed position in the event of a primary means of closing the blades is unworkable. There is a further need for an expandable bit with a release device that allows the expandable bit to move to the closed position in the event that debris forces the blades to remain open. There is yet a further need for an improved expandable bit.

SUMMARY OF THE INVENTION

The present invention generally relates to an apparatus and method of forming a wellbore. In one aspect, an expandable bit for use in a wellbore is provided. The expandable bit includes a body and a blade assembly disposed on the body. The blade assembly is movable between a closed position whereby the expandable bit has a smaller outer diameter and an open position whereby the expandable bit has a larger outer diameter. The expandable bit further includes a release assembly for providing a secondary means to move the blade assembly from the open position to the closed position.

In another aspect, a method of forming a wellbore is provided. The method includes lowering a drill string with an expandable bit at the end thereof through a previously formed wellbore. The expandable bit includes a body, a blade assembly disposed on the body and a release assembly for providing a secondary means to move the blade assembly from the open position to the closed position. The method further includes causing the expandable bit to move from the closed position to the open position and rotating the expandable bit to form a lower portion of the wellbore. The method also includes applying an axial force to the expandable bit and the release assembly to move the blade assembly to the closed position and removing the drill string and the expandable bit from the wellbore.

In yet another aspect, an expandable apparatus for use in forming a wellbore is provided. The expandable apparatus includes a body and cutting members disposed on the body, the cutting members movable between a collapsed position and an expanded position. The expandable apparatus further includes a re-settable release member for allowing the cutting members to move between the expanded position to the collapsed position.

In another aspect, a method for drilling a portion of a wellbore is provided. The method includes lowering an expandable cutting apparatus in the wellbore and expanding the expandable cutting apparatus. The method also includes rotating the expandable cutting apparatus and drilling a portion of the wellbore and collapsing the expandable cutting apparatus.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention relates to a secondary release assembly for an expandable bit. Generally, the release assembly is constructed and arranged to release blade arms of the expandable bit upon the application of a force to the expandable bit.

Figure 1:
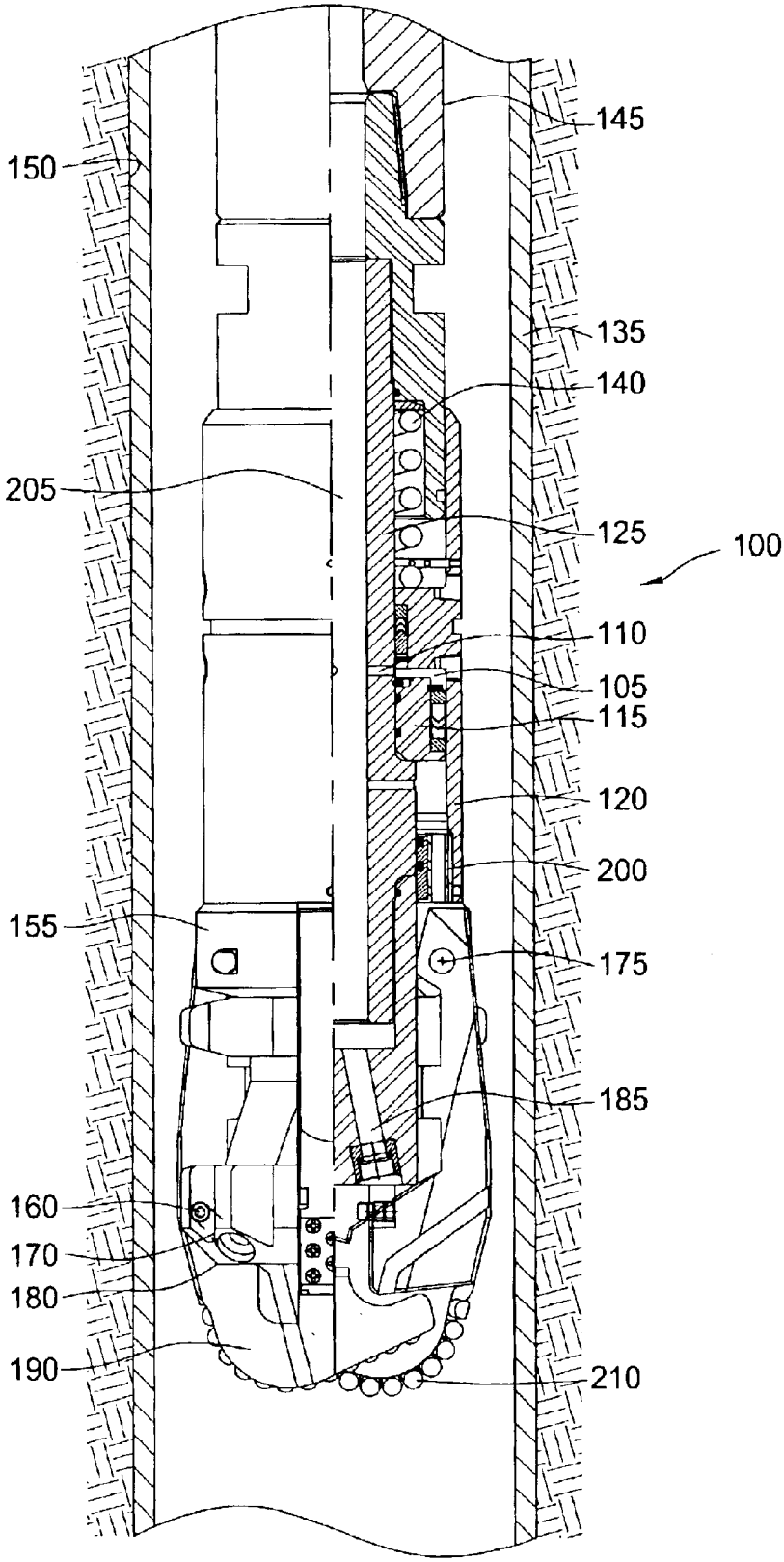
FIG. 1 is a cross-sectional view illustrating an expandable bit disposed at a lower end of a drill string in a partially cased wellbore.

FIG. 1 is a cross-sectional view illustrating the expandable bit 100 disposed at the lower end of a drill string 145 and run-in wellbore 150. As illustrated, the wellbore 150 is lined with casing 135. Generally, the expandable bit 100 may move between an open position and a closed position. In the open position, (FIG. 2) arms 190 at the lower end of the expandable bit 100 are expanded outward while in the closed position the arms 190 are collapsed inward. The arms 190 are attached to a blade pivot housing 155 by a plurality of hinge pins 175. The hinge pins 175 allow the arms 190 to swing out from a body 125 of the bit 100. The arms 190 include a plurality of cutting elements 210 made of a hard material such as tungsten carbide or polycrystalline diamond. The arms 190 are constructed and arranged to permit the cutting elements 210 to contact and drill the earth when the arms 190 are expanded outward and not ream the wellbore or surrounding casing 135 when the arms 190 are collapsed inward. Each arm 190 may carry a single or double row of cutting elements 210 depending on the desired drilling configuration.

As shown in FIG. 1, nozzles 185 are arranged at the lower end of the body 125. The nozzles 185 are in fluid communication with a bore 205 defined in the body 125 to communicate fluid through the expandable bit 100 and allow jetting of the drilling fluid during the drilling operation to remove any cutting build up that may gather in front of the arms 190. The nozzles 185 are also used to create a hydraulic pressure differential within the bore 205 of the expandable bit 100 in order to cause the arms 190 to expand outward as will be discussed herein.

Movement of the arms 190 from the collapsed position to the expanded position occurs when a hydraulic pressure differential created across the nozzles 185 causes a hydraulic cylinder 120 to move axially upward drawing the arms 190 over a head 180. Generally, as fluid is pumped through the expandable bit 100, the nozzles 185 restrict the fluid flow causing the hydraulic pressure differential and urging a portion of fluid through port 110 formed in the body 125 to fill a chamber 105 defined between the hydraulic cylinder 120 and an internal piston 115. As the chamber 105 fills with fluid, the volume of the chamber 105 increases, causing the hydraulic cylinder 120 to move axially upward compressing a biasing member 140. At the same time, the hydraulic cylinder 120 draws the blade pivot housing 155 axially upward, thereby pulling the arms 190 over the head 180. In this manner, the axial force created on the blade pivot housing 155 by the hydraulic cylinder 120 causes the arms 190 to pivot outwards at pins 175 to the expanded position and to remain in the expanded position as long as the hydraulic pressure differential is maintained in the body 125 of the expandable bit 100. Additionally, guide pins 160 act on slots 170 machined in the arms 190 to ensure that the arms 190 return to the closed position upon removal of the hydraulic pressure differential.

Generally, the reduction of fluid flow reduces the pressure differential created by the nozzles 185, thereby causing the fluid pressure in the chamber 105 to be reduced to a hydrodynamic pressure below that required to compress the biasing member 140. In other words, the reduction of the fluid flow allows the biasing member 140 to expand and urge the hydraulic cylinder 120 and the blade pivot housing 155 axially downward pushing the arms 190 over the head 180 and into the collapsed position.

In addition to moving the arms 190 hydraulically, the expandable bit 100 also includes a release assembly 200. The release assembly 200 is generally used in the event that the arms 190 fail to move to the collapsed position by the means previously described. In one embodiment, the release assembly 200 is a threaded connection between the hydraulic cylinder 120 and the blade pivot housing 155. As illustrated on FIG. 1, threads machined on the hydraulic cylinder 120 are mated with threads machined on the blade pivot housing 155 to form the threaded connection. The threads on the hydraulic cylinder 120 and the blade pivot housing 155 are machined to a close fit tolerance. The threads are constructed and arranged to fail or shear when a predetermined axial force is applied to the expandable bit 100. The desired axial force required to actuate the release assembly 200 determines the quantity of threads and the thread pitch. Generally, an axial force is applied to the expandable bit 100 to activate the release assembly 200, thereby allowing the blade pivot housing 155 to move axially downward as will be discussed herein.

Alternatively, other forms of shearable members may be employed in the release assembly 200, as long as they are capable of shearing at a predetermined force. For example, a shear pin (not shown) may be placed between the hydraulic cylinder 120 and the blade pivot housing 155. The shear pin may be constructed and arranged to fail at a predetermined axial force. Generally, a shear pin is a short piece of brass or steel that is used to retain sliding components in a fixed position until sufficient force is applied to break the pin. Once the pin is sheared, the components may then move to operate or function the tool.

Figure 2:
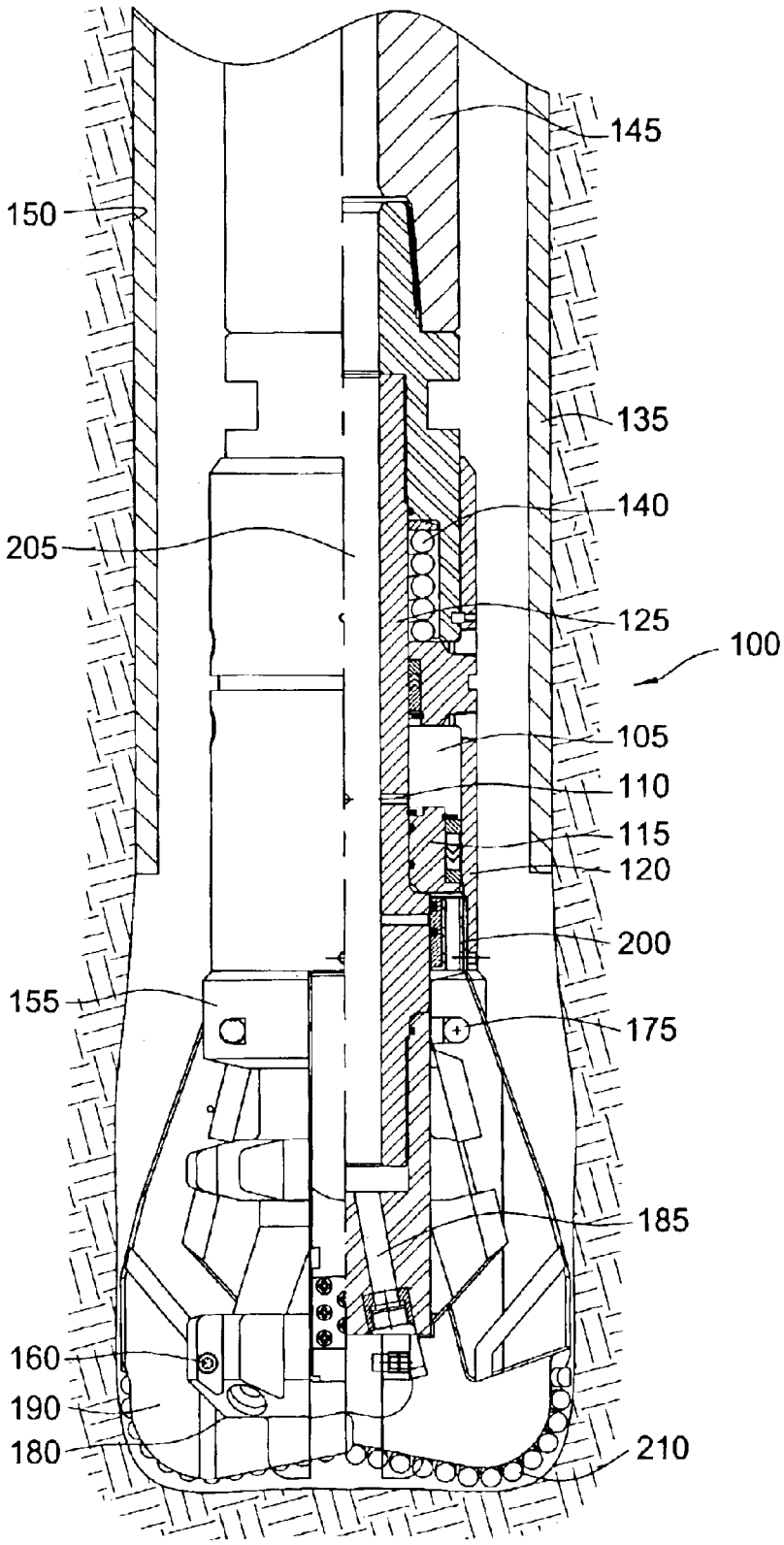
FIG. 2 is a cross-sectional view illustrating the expandable bit forming a lower portion of a wellbore.

FIG. 2 is a cross-sectional view illustrating the expandable bit 100 forming a lower portion of the wellbore 150. After the expandable bit 100 is placed at a desired location in the wellbore 150, the expandable bit 100 may be placed in the open position by pumping fluid through the expandable bit 100. Thereafter, the drill string 145 and the expandable bit 100 are rotated and urged axially downward to form the lower portion of the wellbore 150.

In FIG. 2, the expandable bit 100 is shown the open position and fluid is used to maintain a hydraulic force on the internal piston 115 and the hydraulic cylinder 120. The hydraulic cylinder 120 maintains the arms 190 in the expanded position as discussed in a previous paragraph. In addition to the hydraulic cylinder 120, the drilling load of the expandable bit 100 also keeps the arms 190 in the expanded position.

There are any number of unforeseen wellbore conditions or equipment failure that can lead to the arms 190 being stuck in the expanded position. For example, drilling fluid pumped through the expandable bit 100 may contain debris or other small particles intermixed with the fluid portion. The debris collects in the chamber 105 as more fluid enters the chamber 105 to create the required hydraulic force to move the hydraulic cylinder 120 axially upward. The debris does not necessarily affect the drilling operation while the arms 190 are maintained in the expanded position as shown in FIG. 2. However, after the drilling operation is complete, the debris will typically prevent the chamber 105 from decreasing in volume after the fluid flow is reduced, thereby preventing any axial movement of the hydraulic cylinder 120.

Figure 3:
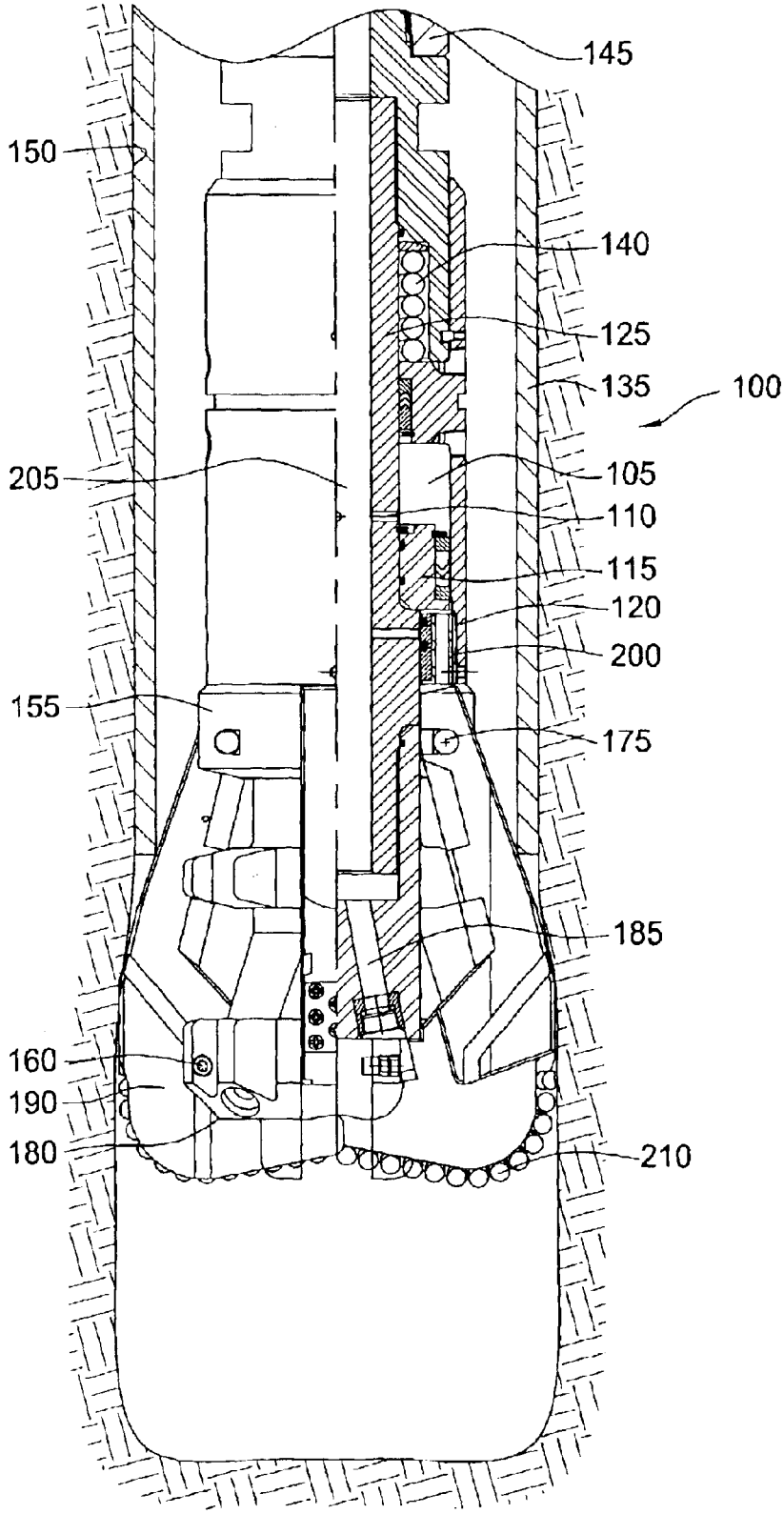
FIG. 3 is a cross-sectional view illustrating the activation of a release assembly.

FIG. 3 is a cross-sectional view illustrating the activation of the release assembly 200. As shown, the arms 190 are in the expanded position, thereby preventing the removal of the expandable bit 100 from the wellbore 150 due to its outer diameter. As discussed previously, any number of unforeseen wellbore conditions or equipment failure can lead to the arms 190 being stuck in the expanded position. To activate the release assembly 200, the drill string 145 and the expandable bit 100 are pulled axially upwards allowing the arms 190 to contact a lower end of the casing 135. As the drill string 145 and the expandable bit 100 continue to be pulled upward, an axial force is created on the release assembly 200. At a predetermined force, the threaded connection between the hydraulic cylinder 120 and the blade pivot housing 155 fails activating the release assembly 200.

Figure 4:
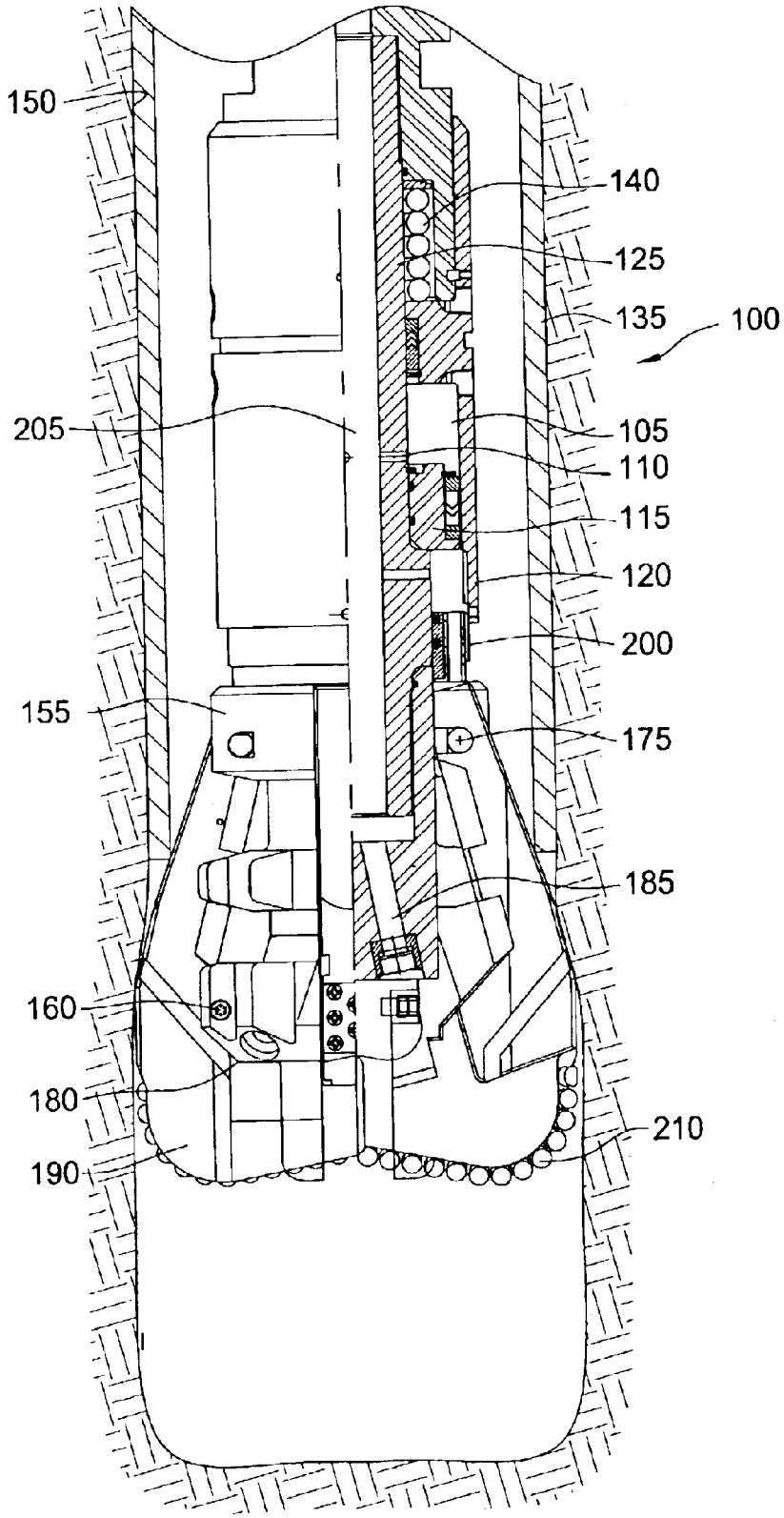
FIG. 4 is a cross-sectional view illustrating a hydraulic cylinder moving axially upward to release a blade pivot housing.

FIG. 4 is a cross-sectional view illustrating the hydraulic cylinder 120 moving axially upward to release the blade pivot housing 155. After the release assembly 200 is activated, the hydraulic cylinder 120 continues to move axially upward until the threads on the hydraulic cylinder 120 and the threads on the blade pivot housing 155 are no longer engaged. At this point, the blade pivot housing 155 may move axially downward pushing the arms 190 over the head 180 and subsequently move into the collapsed position as shown on FIG. 5.

Figure 5:
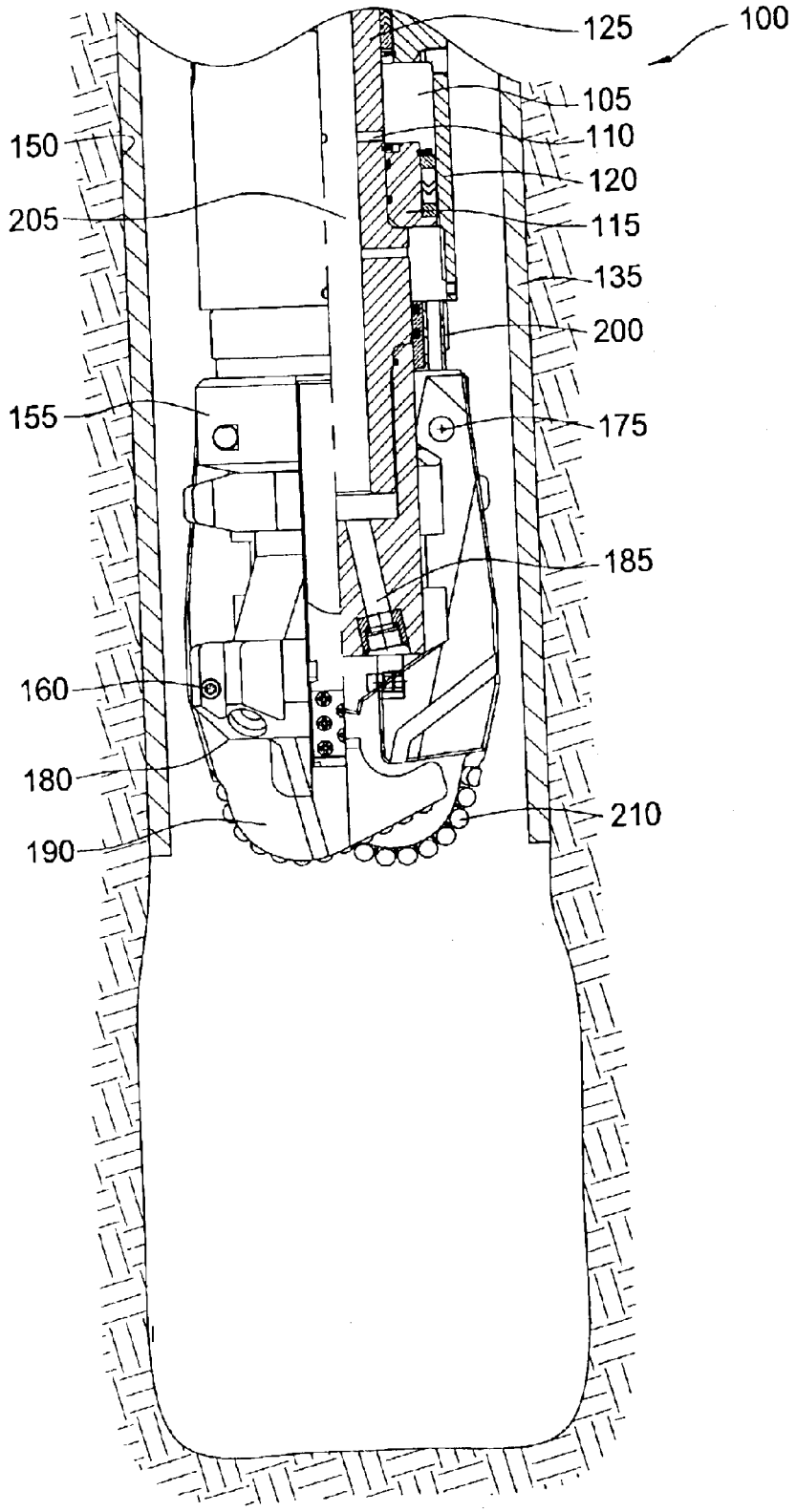
FIG. 5 is a cross-sectional view illustrating the expandable bit being removed from the wellbore.

FIG. 5 is a cross-sectional view illustrating the expandable bit 100 being removed from the wellbore 150. As shown, the threads on the hydraulic cylinder 120 no longer contact the threads on the blade pivot housing 155 and the chamber 105 remains in the expanded state. As further shown, the arms 190 are in the collapsed position, thereby allowing the expandable bit 100 to be removed from the wellbore 150.

Figure 6A:
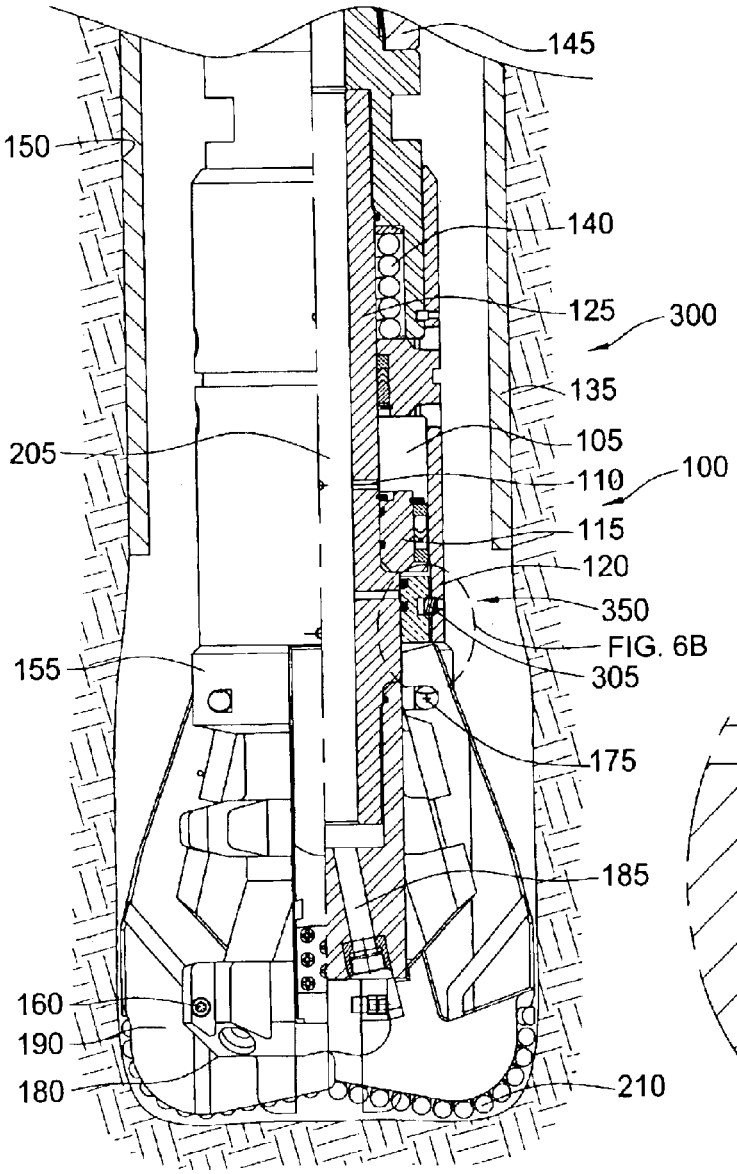
FIG. 6A is a cross-sectional view illustrating an expandable bit with a re-settable release assembly.
Figure 6B:
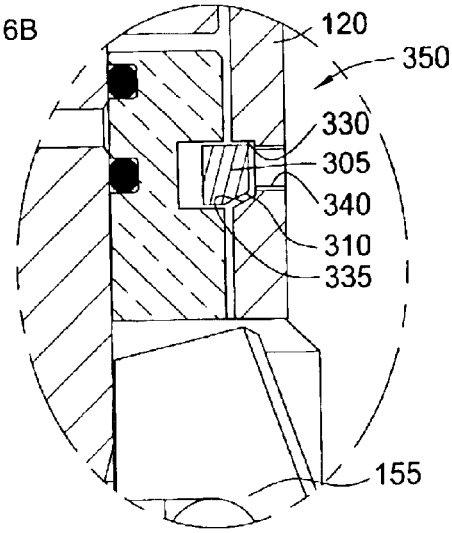
FIG. 6B is an enlarged view of the re-settable release assembly.

While the embodiment in FIGS. 1–5 illustrate the expandable bit 100 with a one-time release assembly 200, an expandable bit with a release assembly that may be used multiple times may also be employed in the wellbore 150. FIGS. 6A and 6B are a cross-sectional view illustrating an expandable bit 300 with a re-settable release assembly 350. For convenience, components on the expandable bit 300 that are similar to the components on the expandable bit 100 will be referenced with the same numbers. Generally, the re-settable release assembly 350 allows the blade pivot housing 155 to collapse the arms 190 upon an application of an axial force and thereafter allows the blade pivot housing 155 to expand the arms 190 upon application of an opposite axial force. In other words, the re-settable release assembly 350 allows the blade pivot housing 155 to release the arms 190 multiple times.

As illustrated in FIG. 6B, the re-settable release assembly 350 includes a split ring 305 with a tapered edge 310. Generally, the split ring 305 is constructed of a metallic material that biases the split ring 305 radially outward. During operation of the expandable bit 300, the split ring 305 is disposed in a groove 330 formed in the hydraulic cylinder 120. The groove 330 includes a tapered edge 335 that mates with the tapered edged 310 formed on the split ring 305. Additionally, a tapped hole 340 disposed adjacent the groove 330 allows a screw (not shown) to urge the split ring 305 radially inward for manual disassembly of the re-settable release assembly 350.

Figure 7A:
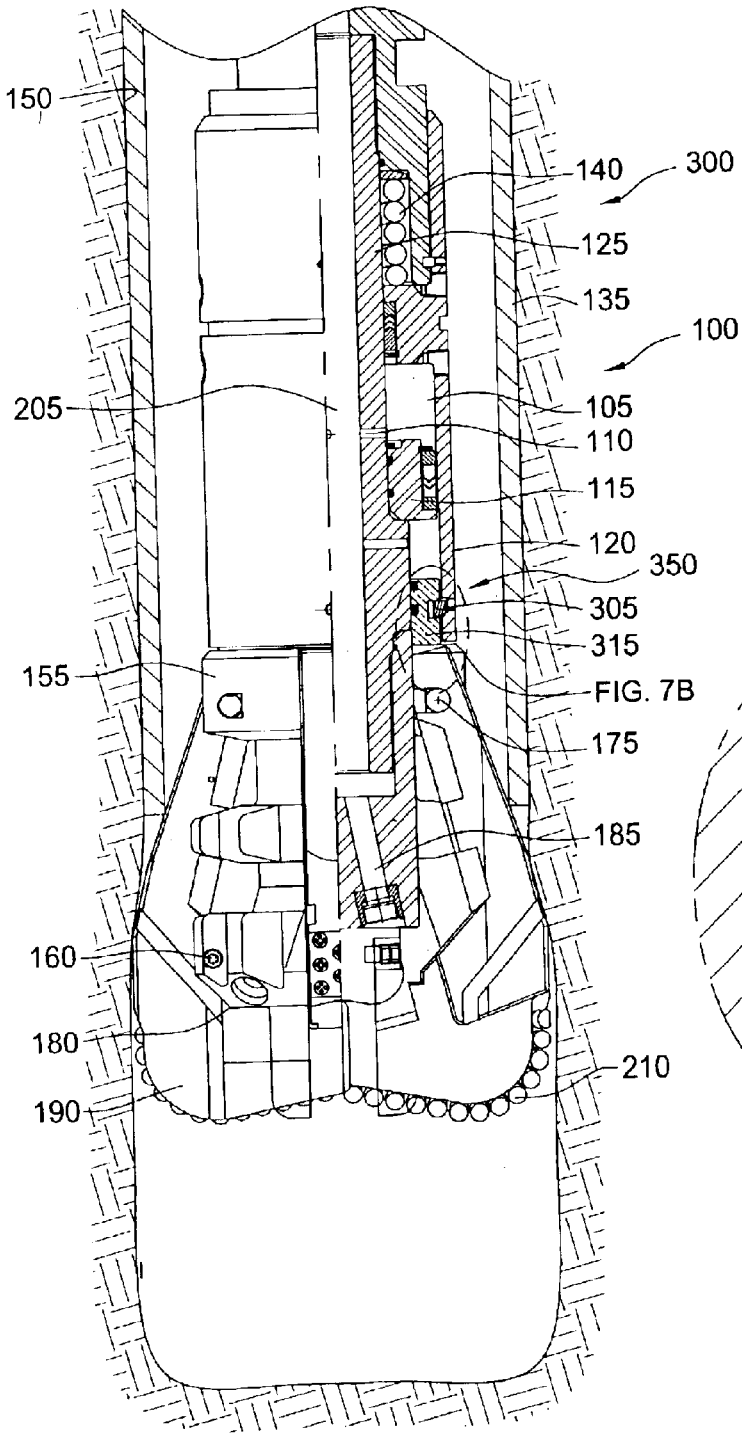
FIG. 7A is a cross-sectional view illustrating the activation of the re-settable release assembly.
Figure 7B:
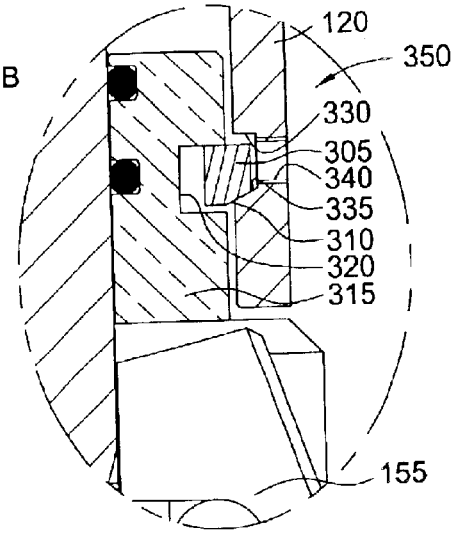
FIG. 7B is an enlarged view of the re-settable release assembly.

FIGS. 7A and 7B are a cross-sectional view illustrating the activation of the re-settable release assembly 350. As shown, the arms 190 are in the expanded position, thereby preventing the removal of the expandable bit 300 from the wellbore 150 due to its outer diameter. As discussed previously, any number of unforeseen wellbore conditions or equipment failure can lead to the arms 190 being stuck in the expanded position. To activate the re-settable release assembly 350, the drill string 145 and the expandable bit 300 are pulled axially upwards allowing the arms 190 to contact a lower end of the casing 135. As the drill string 145 and the expandable bit 300 continue to be pulled upward, an axial force is created on the re-settable release assembly 350. The axial force causes the hydraulic cylinder 120 to move axially away from the blade pivot housing 155. At the same time, the tapered edge 335 in the hydraulic cylinder 120 acts against the tapered edge 310 formed on the split ring 305 causing the split ring 305 to move radially inward toward a piston groove 320 formed in piston 315.

Figure 8A:
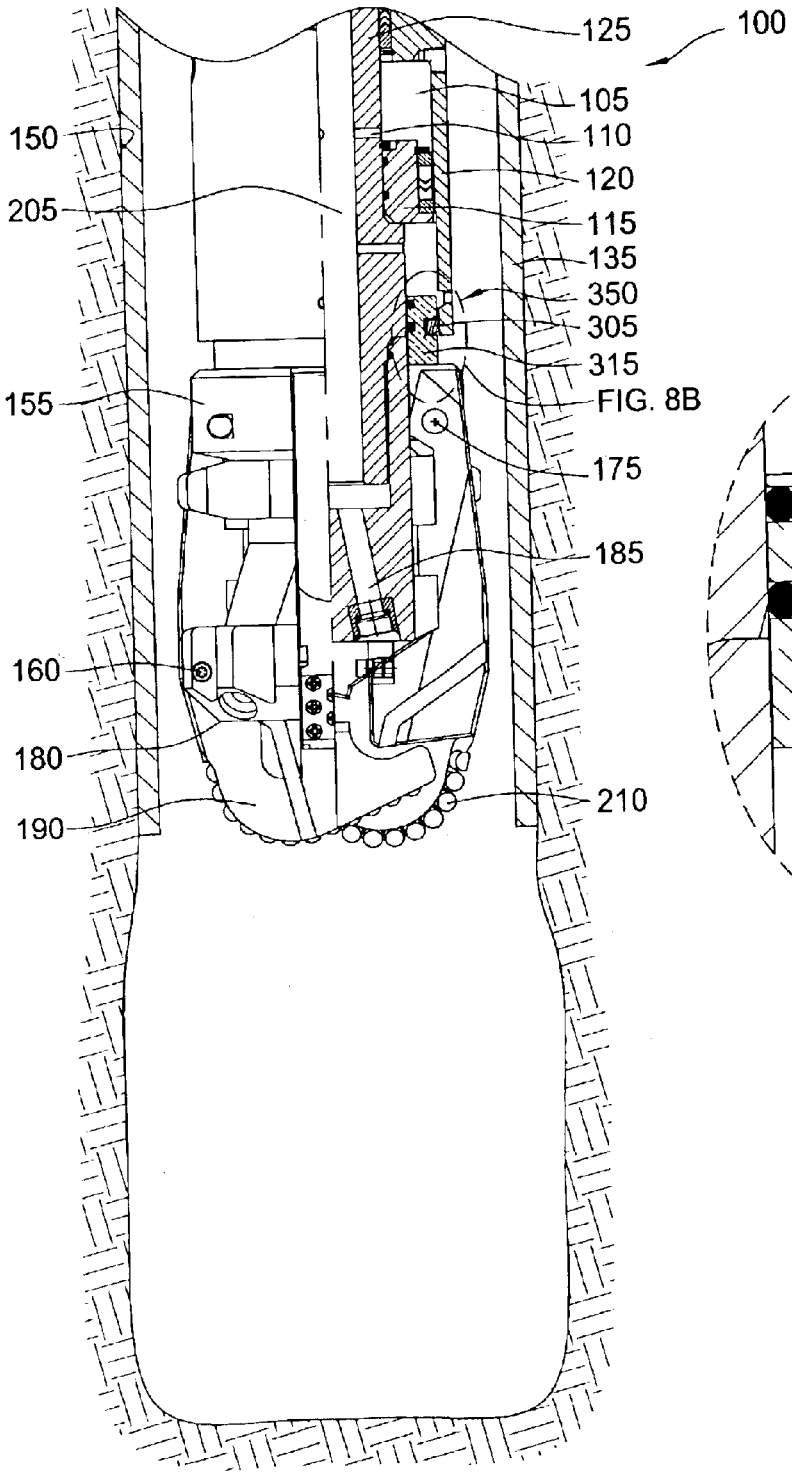
FIG. 8A is a cross-sectional view illustrating the expandable bit after the re-settable release assembly releases the blade pivot housing.
Figure 8B:
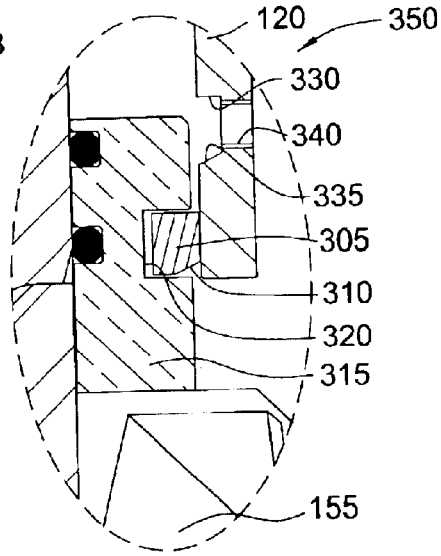
FIG. 8B is an enlarged view of the re-settable release assembly.

FIGS. 8A and 8B are a cross-sectional view illustrating the expandable bit 300 after the re-settable release assembly 350 releases the blade pivot housing 155. As shown, the split ring 305 has moved radially inward into the piston groove 320 and an end of the hydraulic cylinder 120 is disposed adjacent the piston groove 320, thereby containing the split ring 305 within the piston groove 320. Also shown, the chamber 105 remains in the expanded state while the arms 190 are in the collapsed position allowing the expandable bit 300 to be pulled through the casing 135 or another obstruction. After the expandable bit clears the casing 135 or another obstruction, the expandable bit 300 may be re-set by applying a downward axial force on the expandable bit 300. The axial force causes the hydraulic cylinder 120 to move axially downward aligning the groove 330 in the hydraulic cylinder 120 with the piston groove 320 in the piston 315. At this point, the outwardly biased split ring 305 expands radially outward into the groove 330 and the blade pivot housing 155 causes the arms 190 to move from the collapsed position to the expanded position as previously illustrated in FIG. 6A. In this manner, the re-settable release assembly 350 allows the arms 190 to move from the expanded position to the collapsed position and thereafter be reset without removing the expandable bit 300 from the wellbore 150.

In operation, the expandable bit is attached at the lower end of a drill string. Thereafter, the drill string and expandable bit are placed at a desired location in the wellbore and fluid is pumped through the expandable bit. As the fluid flows through the expandable bit, the nozzles restrict the flow causing a hydraulic pressure differential in the bore of the expandable bit. The hydraulic pressure differential urges a portion of fluid through a port in the body of the expandable bit to fill a chamber defined between the hydraulic cylinder and internal piston. As the chamber fills with fluid, the volume of the chamber increases causing a hydraulic cylinder to move axially upward compressing a biasing member. At the same time, the hydraulic cylinder draws the blade pivot housing axially upward, thereby pulling the arms over the head and into the expanded position. Subsequently, the drill string and the expandable bit are rotated while being urged axially downward to form the lower portion of the wellbore.

After the drilling operation, the expandable bit is typically closed hydraulically by reducing the fluid flow through the expandable bit. Generally, the reduction of fluid flow reduces the pressure differential created by the nozzles, thereby causing the fluid pressure in the chamber to be reduced to a hydrodynamic pressure below that required to compress the biasing member. In other words, the reduction of the fluid flow allows the biasing member to expand and urge the hydraulic cylinder and the blade pivot housing axially downward pushing the arms over the head and into the collapsed position. However, there are any number of unforeseen wellbore conditions or equipment failure that can lead to the arms being stuck in the expanded position, thereby requiring the activation of the release assembly.

To activate the release assembly, the drill string and the expandable bit are pulled axially upwards allowing the arms to contact a lower end of the casing or another obstruction. As the drill string and the expandable bit continue to be pulled upward, an axial force is created on the release assembly. At a predetermined force, the threaded connection between the hydraulic cylinder and the blade pivot housing fails, thereby activating the release assembly. At this point, the blade pivot housing is allowed to move axially downward pushing the arms over the head and into the collapsed position. In this manner, the expandable bit moves to the closed position allowing it to be removed from the wellbore.

While the foregoing is directed to embodiments of the present invention, other and further embodiments of the invention may be devised without departing from the basic scope thereof, and the scope thereof is determined by the claims that follow.

What is claimed is:

1. An expandable bit for use in a wellbore, comprising:

a body;

a blade assembly disposed on the body, the blade assembly movable between a closed position whereby the expandable bit has a smaller outer diameter and an open position whereby the expandable bit has a larger outer diameter; and a release assembly for allowing the blade assembly to move from the open position to the closed position, wherein the release assembly comprises a shearable connection between the body and the blade assembly.

2. The expandable bit of claim 1, wherein a predetermined axial force applied to the expandable bit activates the release assembly.

3. The expandable bit of claim 1, wherein the release assembly is disposed between the blade assembly and the body.

4. The expandable bit of claim 1, wherein the shearable connection is formed by engaging a connection means on the body with a mating connection means on the blade assembly.

5. The expandable bit of claim 4, wherein the connection means and the mating connection means are constructed and arranged from at least one thread.

6. The expandable bit of claim 1, wherein the release assembly comprises a shear pin connecting the body to the blade assembly.

7. The expandable bit of claim 6, wherein a predetermined axial force causes the shear pin to fail allowing the blade assembly to move from the open position to the closed position.

8. A method of forming a wellbore, comprising:

lowering a drill string with an expandable bit at the end thereof through a first diameter portion of a wellbore, the expandable bit including:

a body;

cutting members disposed on the body, the cutting members movable between a collapsed position and an expanded position; and a release assembly for allowing the cutting members to move from the expanded position to the collapsed position, wherein the release assembly comprises a shearable connection between the body and the cutting members;

causing the expandable bit to move from the collapsed position to the expanded position;

rotating the expandable bit to form a portion of the wellbore;

operating the release assembly to move the cutting members to the collapsed position; and removing the drill string and the expandable bit from the wellbore.

9. The method of claim 8, further including pumping fluid through the expandable bit.

10. The method of claim 9, further including creating a pressure differential in a bore of the body to open the cutting members.

11. The method of claim 10, further including reducing the flow of fluid through the expandable bit.

12. The method of claim 8, wherein the shearable connection is formed by engaging a connection means on the body with a mating connection means on the cutting members.

13. The method of claim 12, wherein the connection means and the mating connection means are constructed and arranged from at least one thread.

14. The method of claim 8, wherein the release assembly comprises a shear pin that connects the body to the cutting members.

15. The expandable bit of claim 14, wherein a predetermined axial force shears the shear pin causing the cutting members to move from the expanded position to the collapsed position.

16. The method of claim 8, further including applying an axial force to the expandable bit to operate the release assembly.

17. An expandable apparatus for use in forming a wellbore, comprising:

a body;

cutting members disposed on the body, the cutting members movable between a collapsed position and an expanded position; and a release assembly for allowing the cutting members to move from the expanded position to the collapsed position, wherein the release assembly comprises a shearable connection between the body and the cutting members.

18. The expandable apparatus in claim 17, wherein a predetermined axial force applied to the expandable bit activates the release assembly.

19. An expandable apparatus for use in forming a wellbore, comprising:

a body having a slidable member;

at least two cutting members disposed on the body, the at least two cutting members movable between a collapsed position and an expanded position; and a re-settable release assembly for allowing the at least two cutting members to move from the expanded position to the collapsed position, the re-settable release assembly comprising an outwardly biased ring movable radially inward upon contact with the slidable member.

20. The expandable apparatus in claim 19, wherein a predetermined axial force applied to the expandable bit moves a hydraulic cylinder in relation to a blade pivot housing, thereby activating the re-settable release assembly.

21. The expandable apparatus in claim 19, wherein the re-settable release assembly includes a member that moves between a larger diameter position and a smaller diameter position, the member biased towards the larger diameter position.

22. The expandable apparatus in claim 21, wherein the at least two cutting members assume the expanded position when the member is in the larger diameter position.

23. A method for drilling a portion of a wellbore, comprising:

lowering an expandable cutting apparatus in the wellbore;

expanding the expandable cutting apparatus;

rotating the expandable cutting apparatus and drilling a portion of the wellbore; and collapsing the expandable cutting apparatus by activating a re-settable release assembly having an outwardly biased ring, wherein the ring is urged radially inward to allow the expandable cutting apparatus to collapse.

24. A method for drilling a portion of a wellbore, comprising:

positioning an expandable cutting apparatus in the wellbore;

moving the expandable cutting apparatus from a closed position to an open position;

rotating the expandable cutting apparatus and drilling a portion of the wellbore; and shearing a shearable connection to allow the expandable cutting apparatus to move from the open position to the closed position.

* * * * *